US006926575B1

(12) United States Patent
Nakayama et al.

(10) Patent No.: US 6,926,575 B1
(45) Date of Patent: Aug. 9, 2005

(54) METHOD FOR MANUFACTURING FLAT IMAGE DISPLAY AND FLAT IMAGE DISPLAY

(75) Inventors: Shoji Nakayama, Yokosuka (JP); Shigeo Takenaka, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/926,213

(22) PCT Filed: Mar. 23, 2000

(86) PCT No.: PCT/JP00/01772

§ 371 (c)(1),
(2), (4) Date: Sep. 25, 2001

(87) PCT Pub. No.: WO00/60634

PCT Pub. Date: Oct. 12, 2000

(30) Foreign Application Priority Data

Mar. 31, 1999 (JP) ..... 11/94340

(51) Int. Cl.[7] ..... H01J 29/04
(52) U.S. Cl. ..... 445/57; 445/54
(58) Field of Search ..... 313/562, 553, 313/561, 558; 445/9, 38–42, 53–57, 31

(56) References Cited

U.S. PATENT DOCUMENTS 4,031,552 A * 6/1977 Bosserman et al. ..... 348/801
5,529,524 A * 6/1996 Jones ..... 445/24
5,689,151 A * 11/1997 Wallace et al. ..... 313/495
5,697,825 A 12/1997 Dynka et al.
5,827,102 A * 10/1998 Watkins et al. ..... 445/25
5,936,342 A * 8/1999 Ono et al. ..... 313/495
5,977,706 A * 11/1999 Cho et al. ..... 313/553
6,008,576 A * 12/1999 Nakatani et al. ..... 313/495
6,634,916 B2 * 10/2003 Kaneko et al. ..... 445/25

FOREIGN PATENT DOCUMENTS

| | | | |
|---|---|---|---|
| EP | 0 717 429 | 6/1996 | |
| JP | 4-289640 | 10/1992 | |
| JP | 5-151916 | 6/1993 | |
| JP | 08-022785 | 1/1996 | |
| JP | 08022785 A * | 1/1996 | ..... H01J/31/12 |
| JP | 9-82245 | 3/1997 | |
| JP | 9-171768 | 6/1997 | |

* cited by examiner

*Primary Examiner*—Joseph Williams
*Assistant Examiner*—Glenn Zimmerman
(74) *Attorney, Agent, or Firm*—Oblon, Spivak, McClelland, Maier & Neustadt, P.C.

(57) ABSTRACT

On a faceplate having a phosphor layer and a metal back that are formed on a substrate, in a vacuum atmosphere, for instance an active Ba film is deposited as a getter film. Following this, while maintaining the vacuum atmosphere, the faceplate thereon the getter film is deposited and a rear plate having a plurality of electron emitters formed on a substrate are oppositely disposed to form a gap therebetween through a support frame, the gap being hermetically sealed. A flat panel display comprises the active Ba film formed on for instance the metal back as a getter film. Such getter film, while maintaining an activity, is disposed on an image display region in a vacuum vessel, having an excellent getter function.

15 Claims, 3 Drawing Sheets

METHOD FOR MANUFACTURING FLAT IMAGE DISPLAY AND FLAT IMAGE DISPLAY

FIELD OF THE INVENTION

The present invention relates to a method for manufacturing a flat panel display that uses an electron emitter such as a field emission cold cathode or the like, and a flat panel display.

DISCUSSION OF THE BACKGROUND

Recently, by the use of for instance advanced semiconductor machining technology, field emission cold cathodes have been under active study and have been forwarded to apply in flat panel displays. A flat panel display comprises a rear plate in which a lot of field emission electron emitters are formed as electron sources on a substrate, and a face plate formed of a glass substrate or the like thereon a phosphor layer is formed. These are oppositely disposed to each other a prescribed gap apart. Such flat panel displays, different from liquid crystal displays, are self-emitting and can dispense with a backlight. Accordingly, on the basis of these, the flat panel displays are characterized in being lower in power consumption, broader of an angle of sight, and higher in response speed.

In the flat panel display using an electron emitter, a volume of a vacuum vessel formed of the rear plate, the face plate and support frames is remarkably smaller in comparison with that of an ordinary CRT. Despite the above, an area of wall surface releasing gas does not decrease. As a result, when an amount of gas comparable with that of the CRT is released, a pressure increase in the vacuum vessel becomes extremely high. From the above circumstances, getter material plays a particularly important role in the flat panel display. However, the getter material, being electrically conductive, from a point of view of preventing short-circuit of wiring or the like, is restricted in positions to deposit.

To the aforementioned points, it is proposed that the getter material is disposed in the periphery of the vacuum vessel and a getter film is formed in the periphery that does not adversely affect on an image display area (cf. Japanese Patent Publication Nos. HEI 5-151916 JP-A, HEI 4-289640 JP-A or the like). However, in such method of disposing the getter film, the getter film formed at the periphery cannot effectively absorb gases released in the image display area. Accordingly, a high vacuum in the vacuum vessel cannot be maintained over a long period.

From the aforementioned circumstances, it is under study to deposit the getter film in the image display area. For instance Japanese Patent Publication No. HEI 9-82245 JP-A discloses as follows. That is, getter material formed of Ti, Zr or alloys thereof is deposited on a metal back formed on the phosphor layer of the faceplate in one way. In another way, the metal back itself is formed of one the aforementioned getter materials. In still another way, in the image display area, the getter material is deposited in portions other than that of electron emitters of the rear plate.

However, in the flat panel display disclosed in the aforementioned Japanese Patent Publication No. HEI 9-82245 JP-A, the getter material is deposited in the ordinary panel process. As a result, the getter material is inevitably oxidized in its surface. Since the getter material is particularly important of its degree of surface activity, the getter material oxidized in its surface cannot exhibit a satisfying gas adsorption effect.

Accordingly, in the aforementioned gazette, it is disclosed that a space between the face plate and the rear plate is hermetically sealed through the support frame to form a vacuum vessel, thereafter an electron beam or the like being irradiated on the getter material to activate. However, such method cannot effectively activate the getter material. In particular, when the getter material is activated after the formation of the vacuum vessel, gaseous components such as oxygen or the like liberated in the process of activation stick to the electron emitter and the other member. As a result, at this stage, electron emission characteristics or the like are liable to deteriorate.

Furthermore, the getter materials made of Ti, Zr or the alloys of which the aforementioned Japanese Patent Publication No. HEI 9-82245 JP-A official gazette mainly describe have problems that function thereof itself is low. Accordingly, in the flat panel displays operating in the neighborhood of room temperature or at a little higher temperature than that, a sufficient getter function cannot be obtained.

In the aforementioned official gazette, it is disclosed that, as the getter material, evaporable getter materials such as alloys essentially consisting of Ba can be applicable. However, since the evaporable getter materials are assumed to use as alloy, in the flat panel display that operates in the neighborhood of room temperature or at a little higher temperature than that, sufficient gettering action may not be obtained. Furthermore, if the Ba were evaporated to deposit itself as a Ba film, it would be extremely difficult to suppress the getter film from sticking onto unnecessary portions. As a result, short-circuit of wiring or the like is liable to occur.

For instance a reinforcing plate is ordinarily disposed between the faceplate and the rear plate. When the getter material sticks onto such reinforcing plate, there may occur short-circuiting between an electron emitter on a cathode side and a phosphor layer on an anode side to result in an occurrence of broken driver or lighting failure. Accordingly, the aforementioned official gazette states that, when employing the evaporable getter, in order to prevent the wiring from short-circuiting, a device is necessary that restricts a direction into which vapor of the getter material sputters. However, for that, a particular configuration is required to result in a complication.

When the evaporable getter film consisting of an alloy film or the like of which primary component is Ba is formed in the course of ordinary panel process, the getter film (Ba alloy film) is oxidized more rigorously than the getter material consisting of Ti, Zr or alloys thereof is. Accordingly, it is far from exhibiting function as the getter film.

The object of the present invention is to provide a method for manufacturing a flat panel display and a flat panel display itself. Here, in the method for manufacturing the flat panel display, an evaporable getter film of excellent getter function, while maintaining activity, is deposited in an image display area in a vacuum vessel, thereby, the inside of the vacuum vessel is enabled to be a high vacuum with good reproducibility. The flat panel display enables the inside of the vacuum vessel to maintain a high vacuum.

SUMMARY OF THE INVENTION

A method for manufacturing a flat panel display of the present invention comprises depositing a getter film, and disposing a faceplate and a rear plate faced to each other and hermetically sealing a gap therebetween. Here, in the depositing the getter film, the getter film is deposited on the faceplate having a phosphor layer formed on a substrate. In the disposing and hermetically sealing, the faceplate thereon the getter film is deposited and the rear plate having an electron source formed on the substrate are disposed faced to each other to form the gap therebetween and the gap is hermetically sealed.

The method for manufacturing the flat panel display of the present invention is characterized in particular in that the getter film is one formed of evaporable getter material, furthermore essentially of Ba. When the faceplate has a metal back deposited on the phosphor layer, the getter film is deposited on the metal back for instance. Between the faceplate and the rear plate, a support frame is interposed for instance, through the support frame the gap being hermetically sealed.

In the present method for manufacturing the flat panel display, preceding the formation of the getter film, heating/deaerating the faceplate is preferably implemented. By implementing the heating/deaerating, gaseous components in the faceplate can be removed, an intended vacuum in the flat panel display being easily attained. Furthermore, it is preferable to implement the heating/deaerating the rear plate prior to the hermetically sealing. Due to the heating/deaerating, gaseous components in the rear plate can be driven out. In combination with the aforementioned heating/deaerating of the faceplate, the intended vacuum in the flat panel display can be furthermore easily realized.

The present method for manufacturing the flat panel display is further characterized in that the respective processes are implemented in a vacuum atmosphere. At that time, it is preferable to implement the respective processes in a vacuum atmosphere of $1\times10^{-4}$ Pa or better. The respective processes may be continuously or simultaneously implemented in for instance the same manufacturing apparatus. Alternatively, the processes each may be continuously or simultaneously implemented in manufacturing apparatuses independent for the respective processes.

Furthermore, in the present method of manufacturing the flat panel display, the getter film is preferably formed at least partially in an image display area of the faceplate. Furthermore, the getter film is preferably formed mainly in an area other than the area where the phosphor layer is formed. A space area between the faceplate and the rear plate, due to for instance the vacuum atmosphere during the processing and the getter film, is made a vacuum of $1\times10^{-5}$ Pa or better. The processes each are preferable to be implemented in a vacuum atmosphere of $1\times10^{-4}$ Pa or better.

The flat panel display device of the present invention comprises the faceplate, the getter film, and the rear plate. The faceplate has the phosphor layer and the metal back formed on the substrate. The getter film is formed on the metal back and essentially formed of Ba. The rear plate is disposed facing the faceplate with the gap therebetween and has the electron source. Here, the gap between the faceplate and the rear plate is hermetically sealed.

In the flat panel display device of the present invention, the getter film is preferably formed at least partially in the image display area of the faceplate. Furthermore, it is preferable for the getter film to be formed mainly on an area other than that of the phosphor layer on the metal back. The getter film is preferably formed in the Ba film of a thickness of 1 $\mu$m or more. Furthermore, a region between the faceplate and the rear fu plate is preferable to be a vacuum of $1\times10^{-5}$ Pa or better. The gap between the faceplate and the rear plate is, through for instance a support frame, hermetically sealed.

The present flat panel display is characterized in being manufactured at least through depositing the getter film and disposing the faceplate so as to face a rear plate to form the gap therebetween and to hermetically seal the gap. Here, the formation of the getter film is implemented on the faceplate having the phosphor layer formed on the substrate. In the disposing the faceplate so as to face the rear plate to form the gap and to hermetically sealing it, the faceplate thereon the getter film is deposited is disposed facing the rear plate having the electron source formed on the substrate, followed by hermetically sealing the gap.

The present inventors, to cope with the problems involving the existing technology, tried to deposit the getter film without implementing flash operation of the getter material (so-called getter flash) in the flat panel display, which was difficult to implement in the existing device. Therefrom, the present invention resulted.

In the present invention, first on the faceplate where the phosphor layer is formed on the substrate the getter film is formed. Thereafter, the faceplate thereon the getter film is deposited and the rear plate having the electron source are disposed faced to each other so as to form a gap therebetween, followed by hermetically sealing the gap. Thereby, after manufacturing the display, flashing of the evaporable getter material (getter film formation process) such as Ba alloy or the like can be omitted. The getter film is not deposited on the electron source or the like that does not require the getter film. By implementing the aforementioned processes each in a vacuum to prevent the getter film from being oxidized, the flat panel display having the getter film formed of an active Ba film or the like can be manufactured with reproducibility.

The aforementioned processes each, that is, the formation of the getter film on the faceplate and the hermetic sealing of the faceplate having the getter film and the rear plate, may be continuously implemented in the same manufacturing apparatus. A plurality of these processes may be simultaneously implemented. By implementing thus the respective processes in the same manufacturing apparatus, without exposing the getter film formed of for instance the Ba film to an oxidizing atmosphere, the flat panel display may be manufactured. These processes, when a vacuum atmosphere is maintained until the hermetic sealing so that the getter film is not exposed to an oxidizing atmosphere, may be implemented in the manufacturing apparatuses independent for the respective processes.

In the present invention, in more specifically the Ba film as the getter film is deposited on the metal back of the faceplate in a vacuum atmosphere. By heating Ba alloy in a vacuum atmosphere to deposit the Ba, an active Ba film may be formed. Furthermore, by depositing the Ba film before the hermetic sealing, the Ba film may be easily formed only on a prescribed position. The faceplate thereon the active Ba film like this, that is the active getter film that does not substantially have a surface oxide film or the like, is formed, while thereafter maintaining the vacuum atmosphere during the Ba film formation, is welded through the support frame to the rear plate. Thus, a vacuum vessel (envelope) is formed.

As mentioned above, from the deposition of the Ba film to the formation of the vacuum vessel as an envelope is implemented while maintaining a vacuum atmosphere. Thereby, after the formation of the vacuum vessel, without depositing (so called getter flash) the Ba, on the metal back in the image display area the active Ba film may be easily disposed with good reproducibility. The getter film, to the extent where the effect can be obtained, need only be formed at least partially in the image formation region.

The getter film is enough to be extremely thin (for instance 1 μm or more). Accordingly, if not deteriorating the effect of electrons impinging from an electron source on phosphor, that is, if not lowering brightness, the getter film may be formed over an entire image formation region of the faceplate. However, in order to prevent the brightness from lowering, it is preferable for the getter film to be formed mainly on an area on the metal back layer other than that where the phosphor layer is formed.

According to the aforementioned manufacturing method of the present invention, the gap between the faceplate and the rear plate of the flat panel display can be made a vacuum of $10^{-5}$ Pa or better, which is required in obtaining sufficient electron emission characteristics. Thereby, even in a display of large screen, a uniform image can be displayed.

The present flat panel display has the active getter film (the getter film essentially made of Ba, for instance) formed only on a prescribed position. Thereby, during manufacture or use of the display, the getter film may be suppressed from sticking to a position such as the electron source or the like that does not necessitate the getter film. As a result, short-circuiting of the wiring may be suppressed from occurring. Furthermore, a function as the getter film does not deteriorate during manufacture or use of the display. Accordingly, a vacuum of $10^{-5}$ Pa or better can be obtained with reproducibility, and furthermore such vacuum state being maintained over a long period.

Furthermore, the hermetic sealing is implemented in a vacuum atmosphere, thereby after manufacture of the flat panel display exhausting and vacuuming are made unnecessary. Accordingly, a configuration for exhaust such as a tubing for exhaust for instance, furthermore an exhaust device, which are indispensable in the manufacture of the existing display, are made unnecessary. By dispensing with the tubing for exhaust, exhaust conductance can be made larger, exhaust efficiency of the flat panel display being made extremely excellent.

The present flat panel display is manufactured based on the aforementioned manufacturing method of the present invention, thereby the aforementioned effect may be obtained.

DESCRIPTION OF THE PREFERRED EMBODIMENTS

In the following, modes for implementing the present invention will be explained.

Figure 1A:
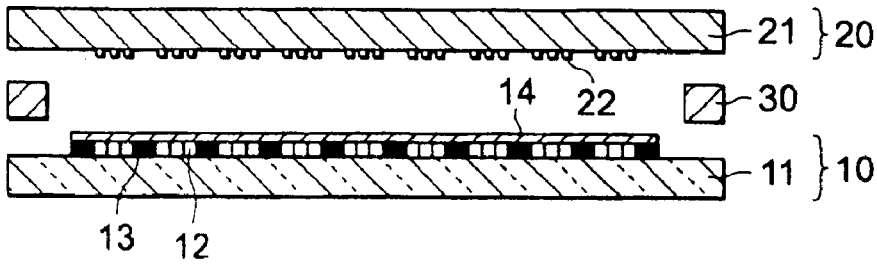
FIGS. 1A, 1B and 1C are sectional views schematically showing essential manufacturing processes of a flat panel display according to one embodiment of the present invention, and a rough configuration of a flat panel display according to one embodiment of the present invention.
Figure 1B:
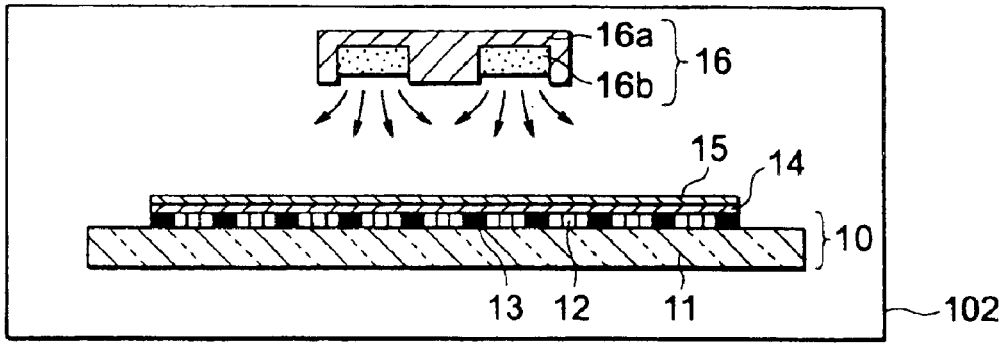

First, a mode of a manufacturing method of a flat panel display of the present invention will be explained with reference to FIGS. 1A, 1B and 1C. As shown in FIG. 1A, first a faceplate 10, a rear plate 20 and a support frame 30 are prepared as usual.

The faceplate comprises a phosphor layer 12 formed on a transparent substrate such as a glass substrate 11. The phosphor layer 12, in the case of a color picture tube, comprises a red emitting phosphor layer, a green emitting phosphor layer and a blue emitting phosphor layer, which are formed corresponding to pixels. In between, black conductive material 13 is disposed to separate. The phosphor layers 12 emitting in the respective colors of red, green and blue and the black conductive material 13 separating therebetween are formed in turn repeating in a horizontal direction. An area where the phosphor layers 12 and the black conductive material 13 exist constitutes an image display area.

The black conductive material 13, according to its shape, is called as black stripe, black matrix or the like. In a black stripe type phosphor film, phosphor stripes of the respective colors of red, green and blue are sequentially formed, stripe like black conductive material separating therebetween. In a black matrix type phosphor film, phosphor dots of the respective colors of red, green and blue are arranged in lattices, between these the black conductive material separating. Various methods for arranging the phosphor dots can be applicable.

On the phosphor layer 12, the metal back 14 is formed. The metal back 14 is made of a conductive thin film such as an Al film. The metal back 14 reflects, among light emitted in the phosphor layer 12, one that proceeds toward a direction of the rear plate 20 having an electron source, resulting in an improvement of the brightness. Furthermore, the metal back 14 gives a conduction to the image display area of the faceplate 10 to suppress electricity from building up there, playing a role of an anode electrode to the electron source of the rear plate 20. The metal back 14 also has a function of suppressing ions from damaging the phosphor layer 12, the ions being generated by ionizing gases remaining in the vacuum vessel by the action of an electron beam.

The phosphor layers 12 and the black conductive material 13, by applying for instance slurry method or printing method, are formed on the glass substrate 11. Thereafter, though depending on an anode voltage or the like, thereon a conductive thin film made of an Al film of a thickness of for instance 2,500 nm or less is formed by means of vacuum deposition method or sputtering method, thereby forming the metal back 14.

The rear plate 20 comprises lots of electron emitters 22 formed on a substrate 21 made of insulating substrates such as glass substrate or ceramic substrate, or Si substrate. These electron emitters 22 are provided with for instance field emission cold cathodes or surface conduction electron emitters. On a formation surface of the electron emitters 22 of the rear plate 20, wiring omitted in the figure is disposed. That is, lots of electron emitters 22 are formed in matrix corresponding to the phosphors of the respective pixels, the wiring (X-Y wiring) being formed intersecting each other to drive the electron emitters in matrix one line by one line.

The support frame 30 hermetically seals a space between the faceplate 10 and the rear plate 20. The support frame 30 is welded to the faceplate 10 and the rear plate 20 by the use of frit glass or indium or alloys thereof. Therefrom, the vacuum vessel as the envelope described below is constituted. To the support frame 30, signal-inputting terminals and row selection terminals that are omitted from showing in the figure are furnished. The respective terminals correspond to cross wiring (X-Y wiring) of the rear plate 20.

Figure 2:
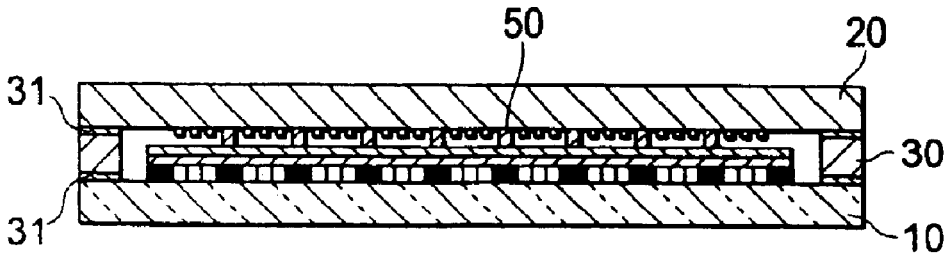
FIG. 2 is a sectional view schematically showing a rough configuration of a flat panel display according to another embodiment of the present invention.

When constituting a large flat panel display or the like, as shown in FIG. 2 for instance, between the faceplate 10 and the rear plate 20, reinforcing plates 50 such as atmospheric pressure support member or spacers may be appropriately disposed. The reinforcing plates 50, the display device being a thin plane table, are disposed to suppress deflection or the like from occurring, or to give mechanical strength against atmospheric pressure. Such reinforcing plates 50 are appropriately disposed in conformity with intended mechanical strength.

The faceplate 10, the rear plate 20 and the support frame 30 as described above are prepared. Thereafter, from depositing the getter film to forming the vacuum vessel as the envelope (welding of the support frame 30 and the faceplate 10, and the rear plate 30) are implemented while maintaining a vacuum atmosphere. For such a series of processes, a vacuum treatment apparatus 100 as shown in for instance FIG. 3 may be used.

Figure 3:
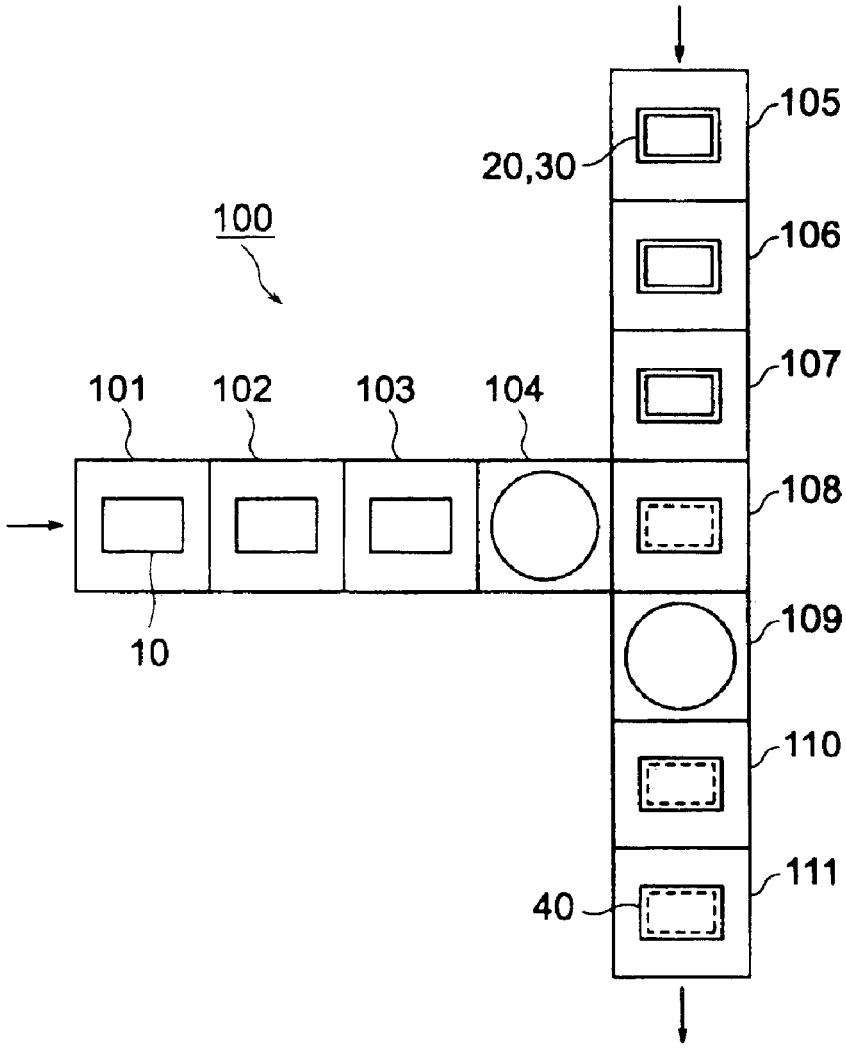
FIG. 3 is a diagram showing one example of configuration of a vacuum treatment apparatus used in manufacturing a flat panel display of the present invention.

The vacuum treatment apparatus 100 shown in FIG. 3 comprises a chamber 101 for loading a faceplate 10, a heating/deaerating chamber 102, a cooling chamber 103, a chamber 104 for vapor depositing a getter film, a chamber 105 for loading a rear plate 20 and a support frame 30, a heating/deaerating chamber 106, a cooling chamber 107, a chamber 108 for assembling the faceplate 10 and the rear plate 20, a heat treatment chamber 109 for welding the support frame 30 to the faceplate 10, a cooling chamber 110, and an unload chamber 111. The respective chambers are treatment chambers where vacuum treatment can be implemented, these treatment chambers being connected therebetween by gate valves or the like.

Figure 4:
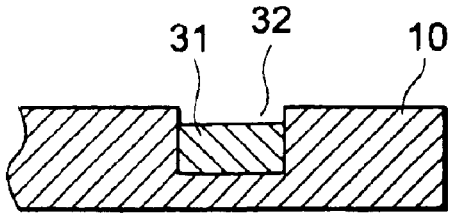
FIG. 4 is a sectional view showing one example of configuration of an end portion of a faceplate.

The faceplate 10 formed up to the metal back 14 is disposed in the load chamber 101. At the end portion of the faceplate 10, as shown in FIG. 4 for instance, a groove 32 is formed. To implement the hermetic sealing with the support frame 30, in the groove 32, indium or alloys thereof is disposed in advance as welding member 31. Then, after an atmosphere in the load chamber 101 is evacuated to a vacuum atmosphere, the faceplate 10 is sent into the heating/deaerating chamber 102.

In the heating/deaerating chamber 102, the faceplate 10 is heated to a temperature from 300 to 320° C. for instance to deaerate the faceplate 10. In the groove 32 at the end portion of the faceplate 10, as the welding member 31, indium or alloy thereof is disposed. In order to prevent indium or alloy thereof from melting due to heating to result in dropping from the groove 32, the faceplate 10 is preferably disposed at a lower portion in the heating/deaerating chamber 102 with the groove 32 directed upward.

The faceplate 10 heated to deaerate is transferred into the cooling chamber 103, being cooled there down to a temperature of for instance 100° C. or less (for instance 80 to 100° C.). The cooled faceplate 10 is sent into the chamber 104 for vapor depositing the getter film. In the vapor deposition chamber 104, as shown in FIG. 1B for instance, an active Ba film 15 is vapor deposited as the getter film on the metal back layer 14.

Specifically, first, in the vacuum treatment chamber 104, in a position facing the metal back 14 of the faceplate 10, a getter device 16 is disposed. In the getter device 16, getter material **16*b* is filled in an annular getter container 16*a* having an opening at one end for example. The getter container 16*a* is composed of metal member such as for instance stainless steel. The getter material 16*b* is filled in the getter container 16*a*** under pressure by means of a press machine. Alternatively, the getter device may be one in which the getter material is filled in a long container with a U-character shaped section, the configuration thereof being not particularly *restricted*.

For the getter material **16*b***, evaporable getter material is used for instance. As the specific examples of the evaporable getter materials, mixed powder of from 40 to 60% by weight of Ba—Al alloy powder and from 60 to 40% by weight of Ni powder, or the like can be cited. In addition, as needs arise, 2.0% by weight or less of nitride powder such as iron nitride powder may be added. As the Ba—Al alloy, $BaAl_4$ alloy is used for instance. The Ba—Al alloy powder and Ni powder may be granulated in advance to use. At this time, all of the Ba—Al alloy powder and the Ni powder may be granulated, or part thereof being granulated.

The getter device as mentioned above is heated from the outside by means of an induction heating apparatus or the like, thereby causing Ba to flash (getter flash) into a vacuum atmosphere. In the case of the mixture of the $BaAl_4$ alloy powder and the Ni powder being used as the getter material **16*b***, when heating these up to approximately 700° C., thereafter a temperature ascends up to approximately 1000° C. due to self-heating. Then, based on the following reaction equation $$BaAl_4+2Ni\ Ba+2Al_2Ni,$$

Ba is flashed to deposit on the metal back 14 of the faceplate 10.

The Ba is preferably flashed in the vapor deposition chamber (vacuum treatment chamber) 104 evacuated down to $1\times10^{-4}$ Pa or better, thereby the Ba film 15 deposited on the metal back 14 being suppressed in contamination by oxygen or carbon. By flashing the getter material under such vacuum atmosphere, the Ba film 15 extremely effective as the getter film, that is the active Ba film 15 not contaminated by oxygen or carbon may be obtained.

The getter material such as Ba—Al alloy, upon heating, flashes the Ba to form a Ba film. Accordingly, an amount of impurities in the getter material is preferable to be reduced. Though not particularly restricted, a total content of carbon, oxygen and nitrogen is preferable to be 0.4% by weight or less. When the getter material in which the amount of the aforementioned impurities is reduced is used, reactivity of the getter material such as Ba—Al alloy or the like may be remarkably improved. More specifically, it is preferable that an amount of carbon is 0.04% by weight or less, that of oxygen being 0.35% by weight or less, that of nitrogen being 0.01% by weight or less. In particular, the carbon promotes a reaction with moisture in the air to cause the getter material to deteriorate in performance as the getter material. Accordingly, the amount of the carbon is more preferable to be 0.02% by weight or less.

Furthermore, particle diameters of these getter material powders, from a viewpoint of causing the reaction of the getter material to occur homogeneously on the whole, are preferable to be 45 $\mu$m or less for the Ba—Al alloy powder and to be 10 $\mu$m or less for Ni powder, for instance. The Ba film obtained from the above getter materials, due to the formation through flashing of the Ba—Al alloy, is substantially free from impurities. However, in view of further improving an effect as the getter film, the purity thereof is preferable to be 100.

The Ba film 15 active as the getter film, when the effect is obtained, may be formed at least partially in the image formation region of the metal back 14. When the brightness is not deteriorated, the Ba film 15 may be deposited on an entire surface of the metal back 14. As mentioned above, when the phosphor layers 12 are separated by the black conductive material (black stripe, black matrix and so on) 13, it is effective to selectively deposit mainly on a portion corresponding to an upper portion of the black conductive material 13. Alternatively, it is effective to selectively form on a region other than the phosphor layers 12. The Ba film 15, when being selectively deposited on the black conductive material 13, may be suppressed from absorbing the electrons impinging on the phosphor layer, thereby a deterioration in brightness being suppressed from occurring.

When the Ba film 15 is selectively deposited on the black conductive material 13, a mask having an appropriate aperture pattern is aligned and fixed for instance on the metal back 14, through the mask the Ba being flashed (getter flash). At this time, the Ba film 15, being deposited on the metal back 14 that also acts as an anode electrode, does not need to be particularly strictly patterned. That is, a portion superposing on the phosphor layer 12, if occurred, does not cause problems.

A thickness of the active Ba film 15, in view of obtaining an effect as the getter film, is preferable to be 1 $\mu$m or more, more preferable to be in the range from 10 to 100 $\mu$m. That is, the active Ba film 15 that is not contaminated from oxygen or carbon, when deposited in a thickness of for instance 1 $\mu$m or more, can exhibit a sufficient getter function to evacuate the inside of the envelop to a state of high vacuum.

Figure 1C:
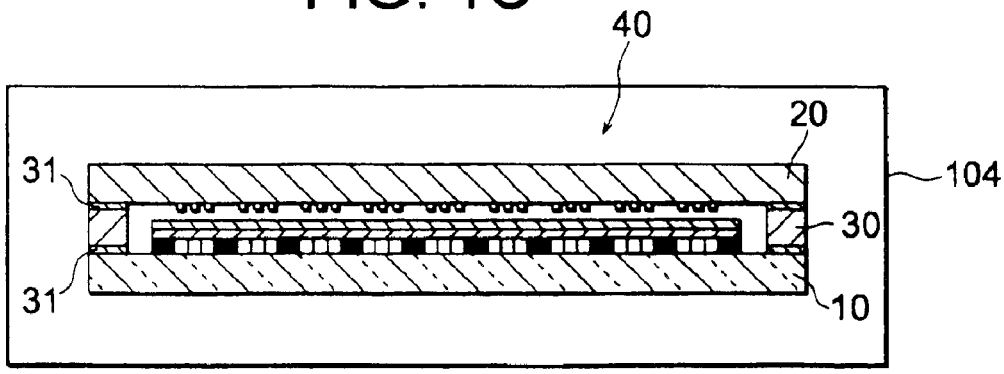

Next, while maintaining activity of a surface of the aforementioned Ba film 15, as shown in FIG. 1C, the faceplate 10 and the rear plate 20 are welded through the support frame 30. In the welding of the support frame 30 to the faceplate 10 and the rear plate 20, first the faceplate 10 thereon the getter film has been deposited in the vapor deposition chamber 104 shown in FIG. 3 is sent into the assembly chamber 108.

Meanwhile, the rear plate 20 in which the electron sources are formed on the substrate and the support frame 30, from an easiness of the process, are preferable to be fixed before disposing in the load chamber 105. The rear plate 20 and the support frame 30, after the atmosphere in the load chamber 105 is evacuated to a vacuum atmosphere, sent into a heating/deaerating chamber 106.

In the heating/deaerating chamber 106, the rear plate 20 and the support frame 30 are heated at a temperature for instance from 300 to 320° C. to deaerate the rear plate 20. Then, the rear plate 20 and the support frame 30 that have been heated/deaerated are sent into the cooling chamber 107 to cool down to a temperature for instance of 100° C. or less (for instance 80 to 100° C.). Similarly with the aforementioned faceplate 10, the cooled rear plate 20 and support frame 30 are sent into the assembly chamber 108.

The inside of the assembly chamber 108 is evacuated to a vacuum atmosphere similar with that of the vapor deposition chamber 104. Specifically, the inside of the assembly chamber 108 is preferable to be evacuated down to $1\times10^{-4}$ Pa or better similarly with the vapor deposition chamber 104. When under such vacuum atmosphere the faceplate 10, the rear plate 20 and the support frame 30 are assembled (aligned), the Ba film 15 formed in the deposition chamber 104 can be kept in an active state. That is, the surface of the Ba film 15 can be suppressed from being contaminated from oxygen or carbon. In assembling, between the faceplate 10 and the rear plate 20, as needs arise, the reinforcing plate 50 as shown in FIG. 2 is disposed.

In such state, a body assembled in the above is further sent into the heat treatment chamber 109 evacuated to the similar vacuum atmosphere, for instance $1\times10^{-4}$ Pa or better. In the heat treatment chamber 109, heat-treatment is implemented at a temperature according to the welding material 31 being used and the faceplate 10 and the rear plate 20 are welded through the support frame 30 under pressure. As needs arise, activation of the electron source or the like is carried out in advance.

Indium or alloys thereof, when using as the welding member 31, is heated for instance at approximately 100° C. to weld. During the welding (during under pressure), to attain further a sufficient welding, ultra-sonic waves can be preferably applied at least to the welding portion. In order to suppress the indium or alloy thereof (welding member 31) disposed in the groove 32 from melting due to heating to drop, the faceplate 10 is preferably disposed at the lower portion inside the heat treatment chamber 109 with the groove 32 directed upward. The rear plate 20 thereon the support frame 30 is fixed is preferably disposed from the above thereof to weld.

In general, the indium or the alloy thereof is said to be insufficient in its bonding strength. However, in the flat panel display of the present invention, the gap between the faceplate 10 and the rear plate 20 is maintained in a vacuum state. Accordingly, due to the atmospheric pressure, only with the indium or the alloy thereof, sufficient strength can be attained. When further enhancing the bonding strength more than that due to the indium or the alloy thereof, the welding portion may be reinforced by means of epoxy resin or the like.

Thus, from the faceplate 10, the rear plate 20 and the support frame 30, the vacuum vessel as the envelope is formed. That is, by hermetically sealing the gap between the faceplate 10 and the rear plate 20 through the support frame 30, a flat panel display 40 is manufactured. Thereafter, the flat panel display 40 is cooled in the cooling chamber 110 down to room temperature, being taken out of the unload chamber 111.

The vacuum treatment chamber 100 used for manufacturing the flat panel display 40, without restricting to an apparatus of continuous method, may be an apparatus in which the respective configurations from the load chamber 101 to the unload chamber 111 are separately combined. As far as the vacuum atmosphere is maintained, the configuration of the vacuum treatment chamber is not particularly restricted.

Of the manufacturing processes of the aforementioned flat panel display 40, from the vapor deposition of the Ba film 15 as the getter film to the manufacture (welding) of the vacuum vessel as the envelope is implemented in a vacuum atmosphere. Accordingly, the active Ba film 15 formed in the deposition chamber 104, without being contaminated from oxygen or carbon, may be disposed as it is in the hermetically sealed envelope.

Thus, the present flat panel display 40 having the active Ba film 15 formed on the metal back 14 can be obtained. That is, first the active Ba film 15 is formed in advance on the metal back 14 located in an image display region. Then, while maintaining the active surface thereof 15, the faceplate 10 and the rear plate 20 are welded through the support frame 30 to form the flat panel display 40. In other words, the flat panel display 40 in which the active Ba film 15 is disposed at a prescribed position in the envelope as the getter film can be obtained.

According to such flat panel display 40, a vacuum state of $1\times10^{-5}$ Pa or better that is demanded for obtaining sufficient electron emission characteristics, furthermore a high vacuum state of $1\times10^{-6}$ Pa or better can be obtained at an initial stage with good reproducibility. This can be obtained by means of the vacuum atmospheres during the aforementioned respective processes and the active Ba film (getter film) 15. The active Ba film 15 is formed on the entire image display region. Accordingly, the aforementioned vacuum can be uniformly attained over the entire envelope of the flat panel display 40.

Furthermore, in the manufacturing processes of the aforementioned present flat panel display 40, in the vacuum atmosphere the hermetic sealing is implemented. Accordingly, after the manufacture of the flat panel display, the exhausting and vacuuming of the inside of the device become unnecessary. Accordingly, a configuration for exhaust such as for instance a tubing for exhaust that is indispensable in the existing apparatus, furthermore an apparatus for exhaust becomes unnecessary. In addition to this, due to the disuse of the tubing for exhaust, exhaust conductance becomes larger, exhaust efficiency of the flat panel display becoming extremely excellent.

Furthermore, in operating the flat panel display 40, even if gaseous components were liberated from the electron emitter 22 or the other periphery member thereof, these gaseous components would be instantaneously absorbed by the active Ba film 15 formed over the entire image display region, that is by the active Ba film 15 excellent in a function as the getter film. As a result, according to the flat panel display 40 of the present invention, the vacuum as mentioned above can be maintained over a long period. In the present flat panel display 40, the vacuum of for instance $10^{-5}$ Pa or better can be maintained for more than 1000 hr.

Furthermore, the Ba film 15 is formed in the manufacturing of the faceplate 10. Accordingly, the active Ba film 15 may be deposited with ease only on the necessary position in the image display region. For instance, even in the case of disposing the reinforcing plate between the faceplate 10 and the rear plate 20, different from the case where the getter flash is implemented after the manufacture of the envelope, such an inconvenience is not caused as that the Ba film sticks to the reinforcing plate to short the cathode (electron emitter 22) and the anode (metal back 14).

Furthermore, the active Ba film 15 is deposited in advance in the manufacture of the faceplate 10. As a result, irrespective of a magnitude of the faceplate 10, at a necessary position in the image display region the active Ba film 15 may be deposited with ease. That is, the inside of the envelope may be excellently and uniformly maintained in a high vacuum state as well as such vacuum state can be maintained with stability over a long period.

The flat panel display 40 as mentioned above may be used in TV display based on TV signals according to for instance the NTSC system. At that time, through the signal input terminal and the row selection terminal that are omitted from showing in the figure, furthermore through a high voltage terminal, the flat panel displays is connected to an external electrical circuit. When indium or alloy thereof that is conductive is used as the welding member 31, the welding member 31 can be used as the terminal.

To the respective terminals, scanning signals are inputted to sequentially drive row by row the electron sources disposed on the flat panel display 40, that is the electron emitters 22 wired in a matrix of M row by N column. Furthermore, modulation signals are inputted to modulate an output electron beam of the selected one row of the electron emitters 22. To the high voltage terminal, an accelerating voltage is applied to give the electron beam being emitted from the electron emitter 22 energy sufficient to excite phosphor.

In the present flat panel display 40 thus configured, by applying the voltage to the respective electron emitters 22 through the terminal, electrons are caused to emit. Furthermore, the high voltage is applied through the high voltage terminal to the metal back 14 to accelerate the electron beam. The accelerated electrons impinge onto the phosphor layer 12, thereby causing to emit, resulting in the formation of the images.

The present flat panel display can be used for various kinds of display devices for instance such as displays of TV receivers or computer terminals.

Next, a concrete embodiment of the present invention will be explained.

EMBODIMENT 1

First, in the vapor deposition chamber 104 of the vacuum treatment apparatus 100 shown in FIG. 3, the faceplate thereon up to the metal back is formed is set at a lower portion thereof. At the same time, at a position of an upper portion thereof facing the metal back the getter device is disposed. For the getter device, one in which getter material of 300 mg containing 48.5% by weight of $BaAl_4$ alloy powder, 50.5% by weight of Ni powder and 1.0% by weight of iron nitride powder is filled in an annular stainless steel getter container with one open end is used. The inside of the vapor deposition chamber 104 is evacuated down to a vacuum of $2\times10^{-4}$ Pa.

Next, the aforementioned getter device is heated from the outside by means of an induction heater to flash (getter flash) Ba. Due to the getter flashing, on the metal back the active Ba film of a thickness of approximately 10 $\mu$m is deposited.

Next, while maintaining the aforementioned vacuum atmosphere, in the assembly chamber 106, the faceplate and the rear plate thereon the support frame is fixed, while aligning, are assembled. Furthermore, in a heat treatment chamber 109 evacuated down to the similar vacuum as above, while continuing evacuation, the faceplate and the rear plate are heat-treated at 100° C. to weld through the support frame.

When the vacuum inside the vacuum vessel (envelope) of thus obtained flat panel display is measured, it is found that a sufficient vacuum is attained. The vacuum is a value obtained uniformly in the respective portions in the vacuum vessel. According to the flat panel display like this, excellent image performance can be obtained. Furthermore, the flat panel display is operated under conditions of room temperature and rated operation for 1000 hr. Thereafter, the vacuum inside the vacuum vessel is measured and found that even after the long period operation the sufficient vacuum is maintained.

Meanwhile, as comparative example 1 of the present invention, a display is manufactured in which in the place of the getter film consisting of the Ba of the aforementioned flat panel display of Embodiment 1, a Ba—Al alloy film is disposed. In the flat panel display of the comparative example 1, immediately after the manufacture, a sufficient vacuum the same as during hermetic sealing is found to maintain. However, when operating the display, an electron beam from the electron source impinges upon the Ba—Al alloy film to generate gases. Due to voltage-breakdown inside the display, a driver is damaged, lighting failure being caused. From these, it is confirmed that the device is very low in practicality as the flat panel display.

Furthermore, as comparative example 2, a display is manufactured in which in the place of the getter film made of the Ba in the flat panel display of Embodiment 1, a Ti—Al alloy film is disposed. In the flat panel display of comparative example 2, immediately after the manufacture, a sufficient vacuum the same as during the hermetic sealing is maintained. However, when operated similarly with Embodiment 1 under the conditions of room temperature and rated operation for 100 hr, brightness lowering occurred. When measuring the vacuum inside the vacuum vessel (envelope), it is confirmed that the vacuum is deteriorated and a sufficient gettering effect is not obtained. As a result, the life thereof was short.

Still furthermore, as comparative example 3, a flat panel display is manufactured where the getter device is disposed at an end portion of the envelope other than the display region. When measuring the vacuum inside the vacuum vessel (envelope) of the display of comparative example 3, a portion close to the getter device was found to have sufficient brightness. In other words, the sufficient vacuum was maintained. However, there was not found light emission in the center of the vacuum vessel. That is, the sufficient vacuum was not maintained. Such state was the same even after the display was operated similarly with Embodiment 1 under the conditions of room temperature and rated operation for 100 hr.

INDUSTRIAL APPLICABILITY

According to a method for manufacturing a flat panel display of the present invention, a Ba film or the like of excellent getter function, while maintaining an activity of a surface thereof, may be disposed in an image display region in a vacuum vessel with ease and with good reproducibility. Accordingly, it is extremely useful as a practical method for manufacturing a flat panel display. Furthermore, a flat panel display of the present invention may maintain the inside of a vacuum vessel as an envelope in a state of high vacuum over a long period. Accordingly, a flat panel display of excellent image characteristics and device characteristics may be provided.

What is claimed is:

1. A method of manufacturing a flat panel display, comprising:

depositing a metal back layer on a faceplate having a phosphor layer formed on a first substrate;

heating the faceplate in a vacuum atmosphere of $1\times10^{-4}$ Pa or less to deaerate the faceplate;

cooling the deaerated faceplate in a vacuum atmosphere of $1\times10^{-4}$ Pa or less;

depositing a getter film made of evaporable getter material on the cooled metal back layer on the phosphor layer without exposing the getter film to an oxidizing atmosphere; and disposing the faceplate thereon the getter film is deposited and a rear plate having an electron source formed on a second substrate so as to face to each other to form a gap therebetween, and hermetically sealing the gap.

2. The method of manufacturing the flat panel display as set forth in claim 1:

wherein the getter film is substantially made of Ba.

3. The method of manufacturing the flat panel display as set forth in claim 1:

wherein the metal back layer is substantially made of aluminum.

4. The method of manufacturing the flat panel display as set forth in claim 1, further comprising:

preceding hermetically sealing, heating/deaerating the rear plate.

5. The method of manufacturing the flat panel display as set forth in claim 1:

wherein the respective processes are implemented in a same manufacturing apparatus continuously or simultaneously.

6. The method of manufacturing the flat panel display as set forth in claim 1:

wherein the respective processes are implemented in manufacturing apparatuses independent for the respective processes continuously or simultaneously.

7. The method of manufacturing the flat panel display as set forth in claim 1:

wherein the phosphor layer has phosphor dots separated by a black conductive material.

8. The method of manufacturing the flat panel display as set forth in claim 7:

wherein the getter film is mainly deposited on a region corresponding to the black conductive material.

9. The method of manufacturing the flat panel display as set forth in claim 1:

wherein the getter film is deposited on almost the entire image display region of the faceplate.

10. The method of manufacturing the flat panel display as set forth in claim 1:

wherein the getter film is deposited mainly in a region other than a region where the phosphor layer is formed.

11. The method of manufacturing the flat panel display as set forth in claim 1:

wherein the getter film has a thickness of 1 $\mu$m or more.

12. The method of manufacturing the flat panel display as set forth in claim 1:

wherein in the hermetic sealing, a support frame is disposed between the faceplate and the rear plate, the gap being hermetically sealed through the support frame.

13. The method of manufacturing the flat panel display as set forth in claim 12:

wherein the support frame and the faceplate are hermetically sealed by indium or an alloy thereof.

14. The method of manufacturing the flat panel display as set forth in claim 1:

wherein the getter film is deposited on a region corresponding to the phosphor layer of the faceplate.

15. The method of manufacturing the flat panel display as set forth in claim 1:

wherein the metal back layer has a thickness of 2500 nm or less.

* * * * *